United States Patent [19]

Hatakeyama et al.

[11] Patent Number: 4,586,623

[45] Date of Patent: May 6, 1986

[54] CONTAINER CAP

[75] Inventors: Yoshiharu Hatakeyama, Tokyo; Yosiro Kikuma, Funabashi, both of Japan

[73] Assignee: Yoshida Industry Co., Ltd., Tokyo, Japan

[21] Appl. No.: 680,647

[22] Filed: Dec. 11, 1984

[30] Foreign Application Priority Data

Feb. 15, 1984 [JP] Japan ..... 59-19085[U]

[51] Int. Cl.[4] ..... B65D 41/28

[52] U.S. Cl. ..... 215/301; 220/281

[58] Field of Search ..... 215/301; 220/281, 282, 220/283

[56] References Cited

U.S. PATENT DOCUMENTS 3,863,798 2/1975 Kurihara et al. ..... 215/301

3,934,751 1/1976 Green et al. ..... 215/301 X 4,180,178 12/1979 Turner ..... 220/281

*Primary Examiner*—Donald F. Norton

*Attorney, Agent, or Firm*—Wenderoth, Lind & Ponack

[57] ABSTRACT

A container cap is disclosed. It has a cap body and a push button member vertically slidably fitted within the cap body. The cap body is integrally formed with a cylindrical wall for engagement with a neck portion of a container, and the push button is integrally provided with a plurality of leg pieces. A plurality of lever pieces are connected at one end thereof to the leg portions and at the other end to the cap body through hinge means, respectively. The intermediate portions of the lever pieces are abutted against a supporting point of the container, whereby the lever members are, upon downward movement of the push button, rotated around the supporting point to thereby push the cap body upward while releasing engagement between the neck portion and the cylindrical wall.

9 Claims, 8 Drawing Figures

CONTAINER CAP

BACKGROUND OF THE INVENTION

This invention relates to a container cap, and particularly to a cap which is vertically detachably fitted in respect to a hollow cylindrical portion of a container.

As conventional containers with caps, two types are known in general; one is a screw type wherein the cap is attached in respect to the hollow cylindrical portion by screw means and the other is an elastic type wherein the retaining projection of the cap is so arranged as to engage with and disengage from that of the container. In these two types, the one with the latter coupling structure can detach the cap with one touch handling. In this sense, the latter is easy to handle when compared with the screw type structure of the former. However, it is rather difficult to set the coupling strength between the cap and the container which creates the following problems.

When the coupling strength between the cap and the container is set to be large, it becomes difficult to detach the cap. Although this is preferable in view of the sealing performance, it badly spoils the smooth handling of the cap for removal. To detach a firmly engaged cap by pulling the cap and the container with both hands is a troublesome job. Besides, a liquid contained in the container may be scattered therearound by the shock of the sudden detachment of the cap. On the other hand, when the coupling strength is made smaller, the cap becomes much easier to be detached. However, at the same time, it is brought to be in a state ready to be detached by mistake.

The present invention was accomplished in view of the above.

SUMMARY OF THE INVENTION

It is therefore a general object of the present invention to provide a container cap wherein the cap can be easily detached even if the coupling strength between the cap and the container is made substantially large, thus offering a container cap easy to handle with.

According to the present invention, a container cap adapted to be detachably engaged with a neck portion of a container is provided which generally comprises a cap body forming an external contour portion of the container cap and a push button member fitted within the cap body slidably in a vertical direction. The cap body has formed integrally therewith substantially at the central portion thereof a cylindrical wall for engagement with the neck portion, and the push button member is formed with a plurality of leg pieces extending downwardly therefrom. A plurality of lever pieces are provided, each of which is, through hinge means, connected at its one end to each of the leg pieces and at its other end to the cap body. The lever piece is arranged such that an intermediate portion thereof is abutted at a lower surface thereof against a supporting point of the container whereby each lever piece is, upon downward movement of the push button, rotated around the supporting point to thereby push the cap body upward while releasing the engagement between the neck portion and the cylindrical wall.

Preferably, the neck portion is provided at an outer surface thereof with an annular protrusion and the cylindrical wall is formed at an inner surface thereof with an annular projection for engagement with the protrusion.

The cap body may include an inner wall surrounding the cylindrical wall, a lower end of the inner wall being connected to the other end of the lever piece.

Other objects, features and advantages of the present invention will be apparent from the following detailed description of preferred embodiments thereof when taken in conjunction with the accompanying drawings, in which:

DETAILED DESCRIPTION OF THE EMBODIMENT

A preferred embodiment of the present invention will be described hereunder in detail with reference to the accompanying drawings in which like numerals denote like or corresponding parts throughout the several figures.

Figure 1:
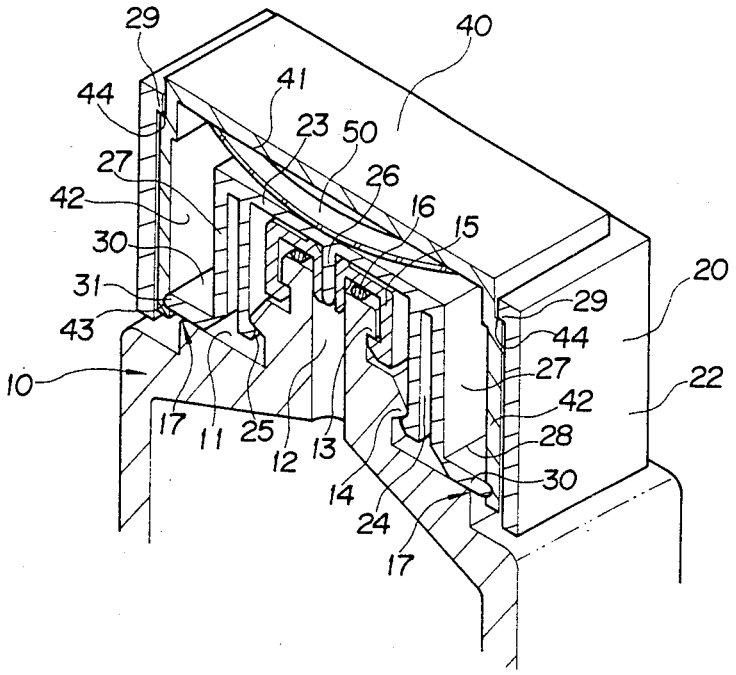
FIG. 1 is a sectional perspective view showing a container cap according to an embodiment of the present invention, in a state engaged with a neck portion of a container.
Figure 2:
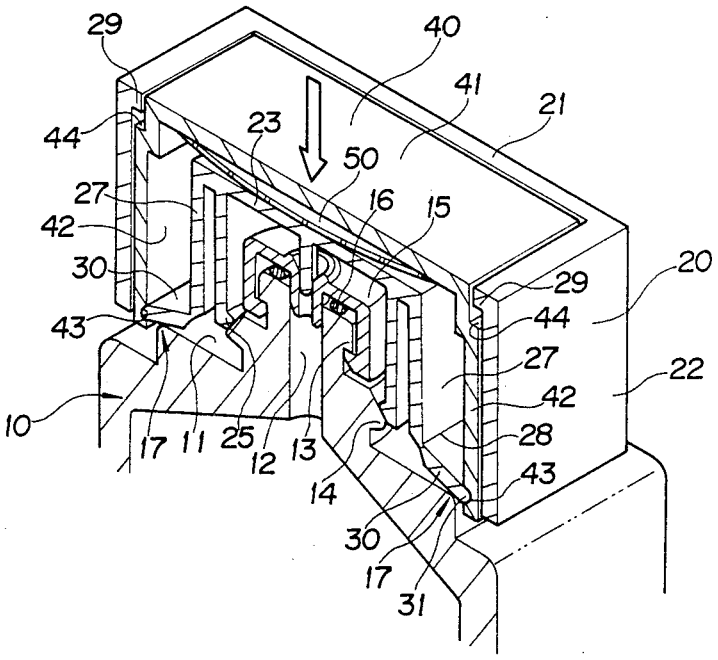
FIG. 2 is also a sectional perspective view of the container cap shown in FIG. 1 but in a operative state.
Figure 3:
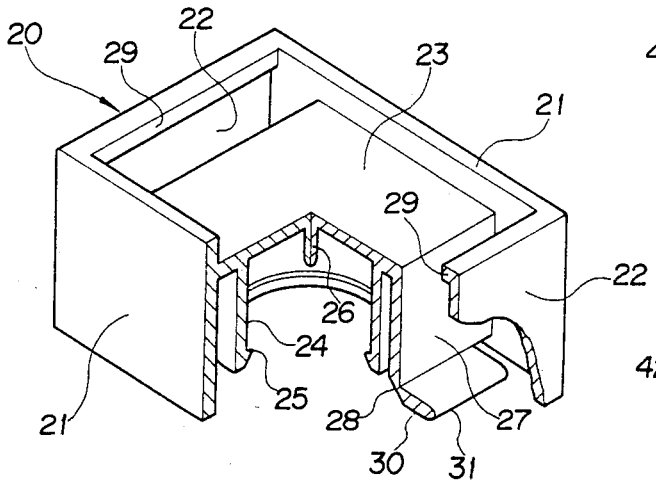
FIG. 3 is a perspective view, partly cut away, of a cap body in the container cap of FIG. 1.
Figure 4:
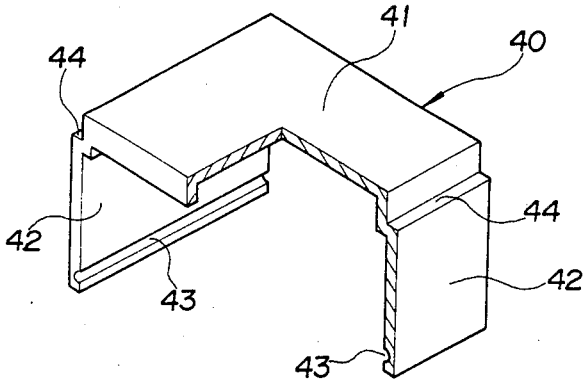
FIG. 4 is likewise a perspective view, partly cut away, illustrating a push button member in the container cap of FIG. 1.

FIG. 1 through FIG. 4 illustrate a preferred embodiment according to the present invention, wherein FIG. 1 illustrates a cap fully coupled with a container 10, while FIG. 2 illustrates the operative state where the cap is being detached from the container 10. Similarly, FIG. 3 and FIG. 4 illustrate a cap body 20 and a button member 40 which represent major parts constituting the cap.

According to this embodiment, the body portion of the container 10 is of a rectangular shape. A shoulder 11 is formed at the central area of the top surface of the container 10 in such a manner as to be raised higher by one step compared with its perimeter. Furthermore, a hollow cylindrical neck portion 12 is formed at the central area of the shoulder 11 in such a manner as to be projected upward therefrom. The neck portion 12 is formed around the upper end portion of the outer periphery thereof with an annular retaining protrusion 13. Also, the neck 12 is formed at the outer periphery of its intermediate portion with an annular retaining protrusion 14 having a diameter larger than that of the protrusion 13. Firmly engaged with the protrusion 13 of the upper end portion is a mid-plug 15 having a small bore which is communicated with the outlet defined within the neck portion 12. An O-ring 16 is interposed between the top face of the neck portion 12 and the mid-plug 15. The retaining protrusion 14 with a larger diameter is adapted to detachably retain the cap. To this end, the top surface of the retaining protrusion 14 is tapered. The foregoing is the constitution on the part of the container 10.

A cap body 20 is a molding of plastic material and has square sleeve-shaped external contours 21,22 which are of approximately same size as that of the contour of the container 10. The external contours 21,21 constitute wall of the long sides opposite with respect to each other, while the other external contours 22 constitute likewise the wall at the short sides. As illustrated in detail in FIG. 3, the top wall 23 of the cap body 20 is formed at a position lower than the upper ends of the external contours 21,22. The top wall 23 is bridged over between the external contours 21,21 forming the long sides and integrally connected thereto. The top wall 23 is not contacted with the short sides 22,22 so as to provide large gaps therebetween.

At the center of the inner surface of the top wall 23, a plug 26 is formed in such a manner as to be projected downward therefrom in order to fit in and block up the bore in the mid-plug 15. The plug 26 is surrounded with a cylindrical wall 24 which has a diameter larger than that of the outer diameter of the neck portion 12 so that it may be located radially outwardly of the portion 12. Provided at the lower end of the wall 24 is an annular projection or flange 25 projecting inwardly for engagement with the retaining protrusion 14 on the neck portion 12. The elastic engagement between the protrusion 14 and the projection 25 maintains the cap in a closed state with respect to the container 10.

The cap body 20 is also integrally formed with inner walls 27,27 which are spaced from and arranged in parallel with the external contours 22,22 forming the short sides. At the lower end of each of the inner walls 27, a board-shaped lever piece 30 is integrally connected thereto through a thin hinge portion 28. Although the inner wall 27 is integrated with the long side external contour 21, the both sides of the lever 30 are not contacted to the long side external contour 21. The lever 30 is arranged to be pivotable around the thin hinge portion 28. The other end of the lever piece 30 opposite to the thin hinge portion 28 is of an arcuate face 31.

The push button member 40 is also a mold of plastic material and includes, as shown in FIG. 4, a rectangular ceiling 41 to be positioned within the external contours 21,22 of the cap body 20, and two leg pieces 42,42 extending downward from the short sides of the ceiling 41 and formed integrally therewith, an entire configuration of the button 40 being a generally reversed U-shape. As shown in FIG. 1 and FIG. 2, the leg pieces 42 of the push button member 40 are mounted inside of the short side external contours 22,22 of the cap body 20 in such a manner as to be contacted thereto slidably in a vertical direction. Thus, the push button 40 is received within the cap body 20 and slidable in the vertical direction with respect to the latter. The ceiling 41 is exposed from the cap body 20 to enable a user to push the button 40.

A leaf spring 50 made of plastic material is interposed between the top wall 23 of the cap body 20 and the ceiling 41 of the push button member 40, thereby normally biasing the push button 40 upward. A step 44 is formed in each of the short sides of the push button member 40 and a stopper 29 corresponding to the step 44 is formed at the upper edge of each of the short side external contour 22 of the cap body 20 in such a manner as to be projected inward therefrom. The push button 40 is retained in its upper extreme position by engagement between the step 44 and the stopper 29.

Also, an arcuate hinge groove 43, corresponding to the arcuate end face 31 of the lever piece 30, is formed in the inner surface at the lower end of each of the leg pieces 42,42 of the push button member 40 in order to receive the end 31 of the lever piece 30. With this constitution, the lever piece 30 is hingedly connected at its one end with the hinge groove 43 of the leg piece 42, while the other end of the lever piece 30 is connected to the inner wall 27 by thin hinge portion or hinge means 28.

The cap in FIG. 1 is fully engaged with the container 10. At this time, the lever piece 30 is held generally horizontally and an inner half thereof is substantially contacted with the upper surface of the shoulder 11 of the container 10.

In the above state, in order to detach the cap from the container 10, the push button member 40 is pressed downward against the biasing force of the spring 50, as shown in FIG. 2. This pressure is transmitted to one end portions 31 of the lever pieces 30 through the leg pieces 42 thereby pressing the end portions 31 downwardly. As a result, the edge of the shoulder 11 contacting the lower surfaces of the intermediate portions of the lever pieces 30 serves as a supporting point 17 or pivotal point around which the lever pieces 30 are rotated. Due to this rotation the internal end portions of the lever pieces 30 are displaced upward. In other words, the inner walls 27 of the cap body 20 which are integrated with the lever pieces 30 through the thin hinge means 28 are pushed upward. The push-up force is transmitted to the cap body 20, thereby moving the latter upwardly while elastically releasing the engagement between the protrusions 14 and the projections 25. As a result, the cap is detached from the container 10.

In this way, by placing the container 10 coupled by this cap on, for example, a table and pressing the push button 40 downward, the cap can be easily detached from the container 10. Therefore, even if the coupling strength between the cap and the container is made sufficiently large, the cap can be detached extremely easily without fail.

Figure 5:
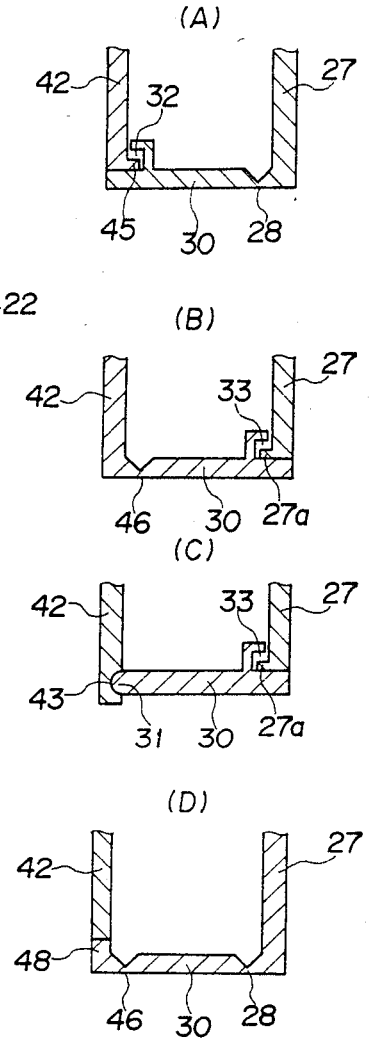
FIGS. 5(A) through (D) are partly sectional views illustrating other examples of hinge structure for lever pieces in the container cap of FIG. 1.

It should be understood that the hinge structure between the leg piece 42 of the push button member 40 and the lever piece 30, and the hinge structure between the inner wall 27 of the cap body 20 and the lever piece 30 are not limited to the above embodiment. Alternatively, various hinge structures can be employed. Several such examples are shown in FIG. 5. In FIG. 5(A), the leg piece 42 is formed with a hook-shaped protrusion 45 at its lower end, and a hinge groove 32 corresponding thereto is formed on the upper face of the lever 30 for mutual engagement. Similarly, in FIG. 5(B), the leg piece 42 is integrated with the lever piece 30 at its lower end through a thin hinge portion 46, and this lever piece 30 and the inner wall 27 is hingedly coupled together by means of a hinge groove 33 and a hook-shaped protrusion 27*a*. In an example shown in FIG. 5(C), the thin hinge portion 46 in FIG. 5(B) is replaced by the hinge groove 43 and the arcuate face 31 engageable therewith, and the lever piece 30 is formed separately. Also, in FIG. 5(D), the lever piece 30 is integral with the inner wall 27 through the thin hinge portion 28, while the other end of the lever piece 30 is extended at 48 through the thin hinge portion 28 and the extension 48 is secured to the leg piece 42.

The leaf spring 50 biasing the push button 40 upward ensures that the button 40 is maintained at its upper most position when no external force is applied thereto. However, it is not essential to provide the spring 50 since the lever piece 30 contacting the shoulder 11 pushes up the button 40. Therefore, the spring 50 can be eliminated if so desired and, in that case, the button 40 can be pushed in more lightly.

As apparent from the foregoing description, according to the cap of the present invention, the detaching or releasing force is exerted due to the lever function of the lever piece 30. Therefore, if the distance between the supporting point and the point of force and the distance between the supporting point and the point of action are suitably set, the pressing force to be applied to the push button 40 in order to release the engagement of the projection 25 with the protrusion 14 can be reduced extensively due to the amplifying action of the lever.

In the above described embodiment, the container 10 as well as the cap are of square shapes. Of course, the present invention can be applied to a cylindrical container and cap, as well. In that case, it is preferable to divide the leg piece of the push button member into three pieces and spacedly arrange them at 120 angles. Because of such arrangement, the push-up force with respect to the cap is exerted to its entirety equally.

As described in detail in the foregoing, according to the container cap of the present invention, even if the coupling strength between the cap and the container is sufficiently increased, the cap can be detached in a simple manner and is extremely easy to handle with.

While specific embodiment of the invention has been shown and described in detail to illustrate the application of the principles of the invention, it will be understood that the invention may be embodied othewise without departing from such principles.

What is claimed is:

1. A container cap adapted to be detachably engaged with a neck portion of a container, comprising:

a cap body forming an external contour portion of the container cap;

a cylindrical wall formed integrally with said cap body substantially at the central portion thereof for engagement with said neck portion;

a push button member fitted within said cap body and being slidable in a vertical direction with respect to said cap body;

a plurality of leg pieces formed integrally with said push button member and extending downwardly therefrom; and a plurality of lever pieces each, through a hinge means, connected at its one end to each of said leg pieces and at its other end to said cap body, each said lever piece being arranged such that an intermediate portion thereof is abutted at a lower surface thereof against a supporting point of said container whereby each said lever piece is, upon downward movement of said push button member, rotated around said supporting point to thereby push said cap body upward while releasing the engagement between said neck portion and said cylindrical wall.

2. A container cap as claimed in claim 1, wherein said neck portion is provided at an outer surface thereof with an annular protrusion and said cylindrical wall is formed at an inner surface thereof with an annular projection for engagement with said protrusion.

3. A container cap as claimed in claim 1, wherein said cap body further includes an inner wall surrounding said cylindrical wall, a lower end of said inner wall being connected to said other end of each said lever piece.

4. A container cap as claimed in claim 1, wherein said hinge means comprises a thin wall portion.

5. A container cap as claimed in claim 1, wherein said hinge means comprises an arcuate end face and an arcuate hinge groove for receiving said end face.

6. A container cap as claimed in claim 1, wherein said hinge means comprises a hook-like protrusion and a hinge groove for receiving said protrusion.

7. A container cap as claimed in claim 1, wherein an upper surface of said container is provided with a step to form said supporting point.

8. A container cap as claimed in claim 1, wherein said cap body further includes a top wall having formed centrally thereof a plug for closing an opening in said neck portion.

9. A container cap as claimed in claim 1, further comprising a spring means for biasing said push button member upwardly.

* * * * *